US010364824B2

(12) United States Patent
Wu et al.

(10) Patent No.: US 10,364,824 B2
(45) Date of Patent: Jul. 30, 2019

(54) ADAPTER STRUCTURE FOR VENTILATING FAN

(71) Applicants: Panasonic Ecology Systems Guangdong Co., Ltd., Foshan, Guangdong (CN); Panasonic Corporation, Osaka (JP)

(72) Inventors: Qiming Wu, Guangdong (CN); Qiuqian Liang, Guangdong (CN); Naoya Araki, Aichi (JP); Masato Suzuki, Aichi (JP)

(73) Assignees: PANASONIC ECOLOGY SYSTEMS GUANGDONG CO., LTD. (CN); PANASONIC CORPORATION (JP)

( * ) Notice: Subject to any disclaimer, the term of this patent is extended or adjusted under 35 U.S.C. 154(b) by 349 days.

(21) Appl. No.: 14/887,694

(22) Filed: Oct. 20, 2015

(65) Prior Publication Data

US 2016/0208814 A1 Jul. 21, 2016

(30) Foreign Application Priority Data

Jan. 19, 2015 (CN) ..... 2015 2 0036856 U

(51) Int. Cl.

| | |
|---|---|
| ***F04D 29/44*** | (2006.01) |
| ***F04D 29/62*** | (2006.01) |
| ***F04D 25/08*** | (2006.01) |
| ***F04D 29/42*** | (2006.01) |

(52) U.S. Cl.

CPC ..... *F04D 29/441* (2013.01); *F04D 25/08* (2013.01); *F04D 29/4226* (2013.01); *F04D 29/626* (2013.01)

(58) Field of Classification Search

CPC ..... F04D 25/08; F04D 25/088; F04D 25/12; F04D 25/441; F04D 29/624; F04D 29/626; F04D 29/441; F24F 1/38; F24F 13/0254; F24F 13/0272; F24F 13/084; F24F 2013/205; F24F 7/06; F24F 7/007; F24F 7/065

USPC ..... 454/249, 251, 341, 349, 350

See application file for complete search history.

(56) References Cited

U.S. PATENT DOCUMENTS 6,776,704 B2 * 8/2004 Goncalves ..... F23L 17/04 126/85 B

2012/0164936 A1 * 6/2012 Gao ..... F24F 7/007 454/341

FOREIGN PATENT DOCUMENTS

WO WO 0055547 A1 * 9/2000 ..... F24F 13/082

* cited by examiner

*Primary Examiner* — Justin D Seabe
*Assistant Examiner* — Julian B Getachew
(74) *Attorney, Agent, or Firm* — RatnerPrestia

(57) ABSTRACT

An adapter structure for a ventilating fan, including an adapter having an air inlet; an air guide structure having an air inlet, and a mounting structure for mounting the air guide structure within the adapter. The mounting structure includes a first portion provided at an outer side of a flange of the air inlet of the air guide structure and a second portion provided at an inner side of the adapter so that the mounting structure is positioned between the air inlet of the air guide structure and the air inlet of the adapter. With the adapter structure for a ventilating fan according to the present invention, the airflow amount is prevented from being reduced, and noise is reduced.

7 Claims, 9 Drawing Sheets

ADAPTER STRUCTURE FOR VENTILATING FAN

CROSS-REFERENCE TO RELATED APPLICATION

This application claims the benefit of the Chinese Patent Application No. 201520036856.4 filed on Jan. 19, 2015 in the State Intellectual Property Office of China, the whole disclosure of which is incorporated herein by reference.

BACKGROUND OF THE INVENTION

Field of the Invention

The present disclosure relates to a ventilating fan, and particularly, to an adapter structure for a ventilating fan.

Description of the Related Art

FIG. 1 is a schematic diagram showing a structure of a ventilating fan in the prior art, which, for example, is described in Chinese patent ZL201010130174.1. In order to reduce a height difference between an air outlet (not shown) of a casing (not shown) and an air inlet 403 of an adapter 400 in a ventilating fan (not shown) so that air blown out from the air outlet of the casing is smoothly guided through the air inlet 403 of the adapter 400, the adapter 400 is provided with an air guide structure 210 mounted therein. The air guide structure 210 has an air inlet 215 of the same shape as the air outlet of the casing so as to form a direct-through configuration with the casing. A connection between the adapter 400 and the air guide structure 210 is achieved through engagement between openings and stop catches. Specifically, a plurality of openings 401 are formed in the peripheral wall of the adapter 400, and a plurality of stop catches 214 are provided on the peripheral wall of the air outlet 212 of the air guide structure 210. When the air guide structure 210 is inserted into the adapter 400, the distal ends of the stop catches 214 snapped in the openings 401 in the adapter 400. With elasticity of the stop catches 214, the air guide structure 210 is fixed within the adapter 400.

With the adapter 400 of the ventilating fan mentioned in this background, the stop catches 214 of the air guide structure 210 need to be snap-fitted in the openings 401. However, since there are fitting gaps left between the stop catches 214 and the openings 401, an airflow generated by a fan (not shown) will flow to the air outlet 212 of the air guide structure 210 and may leak out from the fitting gaps between the stop catches 214 and the openings 401 when the ventilating fan is operated, resulting in a reduced amount of airflow and an increased noise due to sharply diffused airflow.

SUMMARY OF THE INVENTION

An object of the present invention is to provide an adapter structure for a ventilating fan for preventing reduction in airflow and reducing noise.

In order to achieve the above object, the present disclosure provide an adapter structure for a ventilating fan, comprising: an adapter having an air inlet; an air guide structure having an air inlet, and a mounting structure for mounting the air guide structure within the adapter, wherein the mounting structure comprises a first portion provided at an outer side of a flange of the air inlet of the air guide structure and a second portion provided at an inner side of the adapter so that the mounting structure is positioned between the air inlet of the air guide structure and an air inlet of the adapter.

With the adapter structure for a ventilating fan according to the present invention, the airflow amount is prevented from being reduced, and noise is reduced.

DETAILED DESCRIPTION OF PREFERRED EMBODIMENTS OF THE INVENTION

Figure 2:
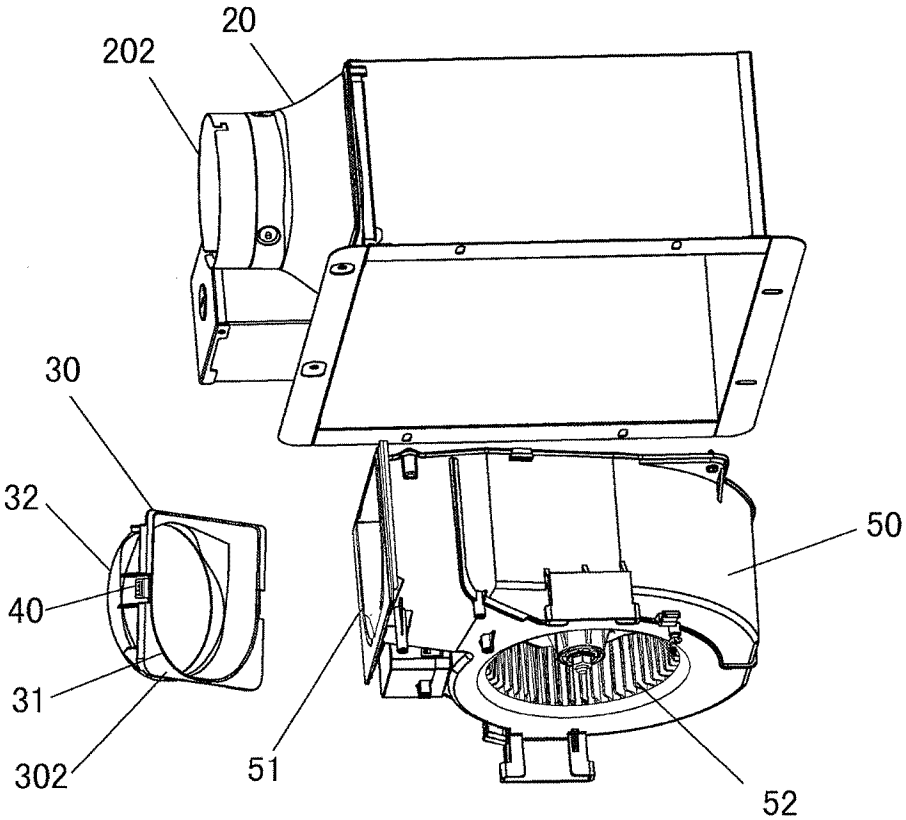
FIG. 2 is an exploded view of a ventilating fan according to a first embodiment of the present disclosure.
Figure 3:
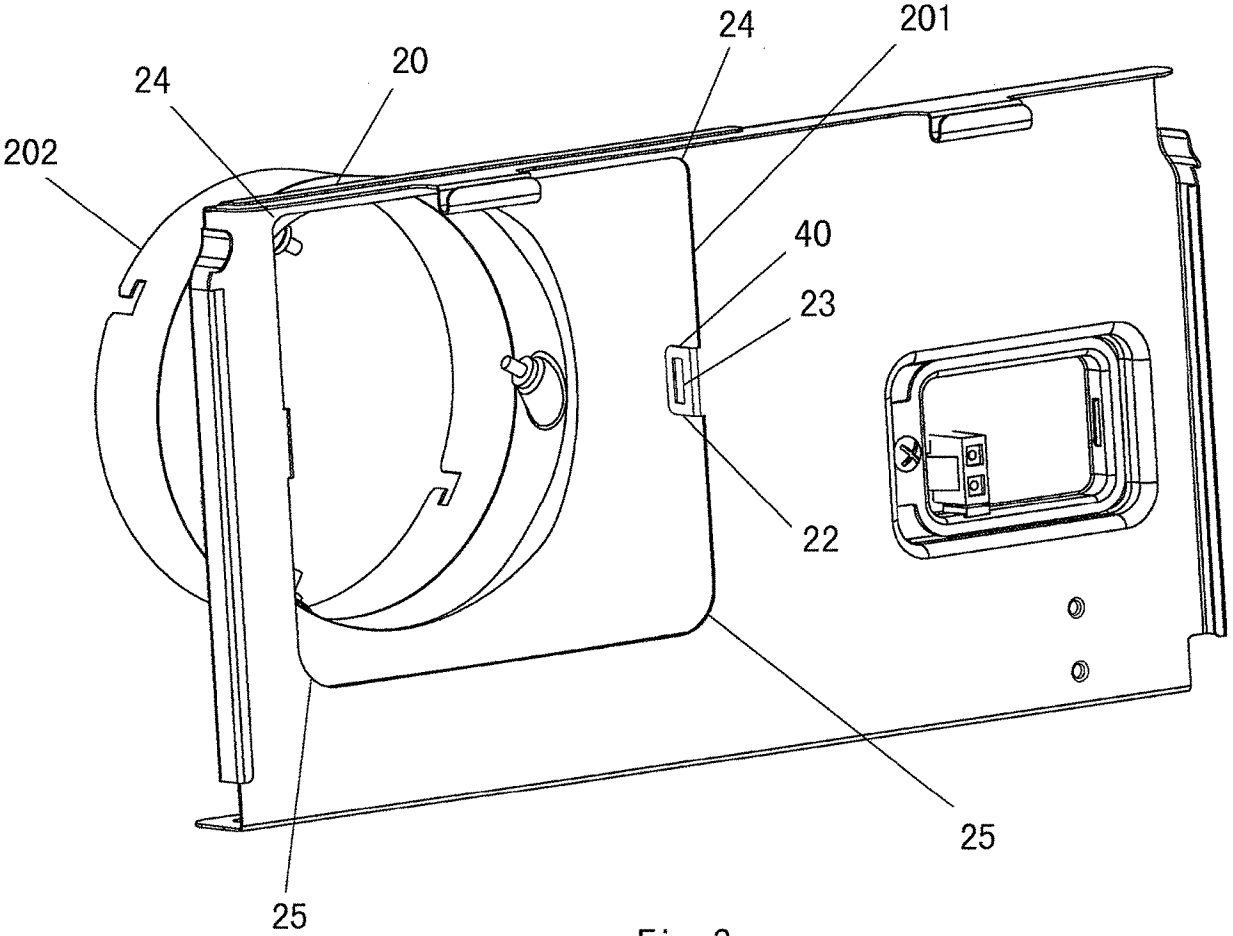
FIG. 3 is a schematic diagram of an adapter according to the first embodiment of the present disclosure.
Figure 4A:
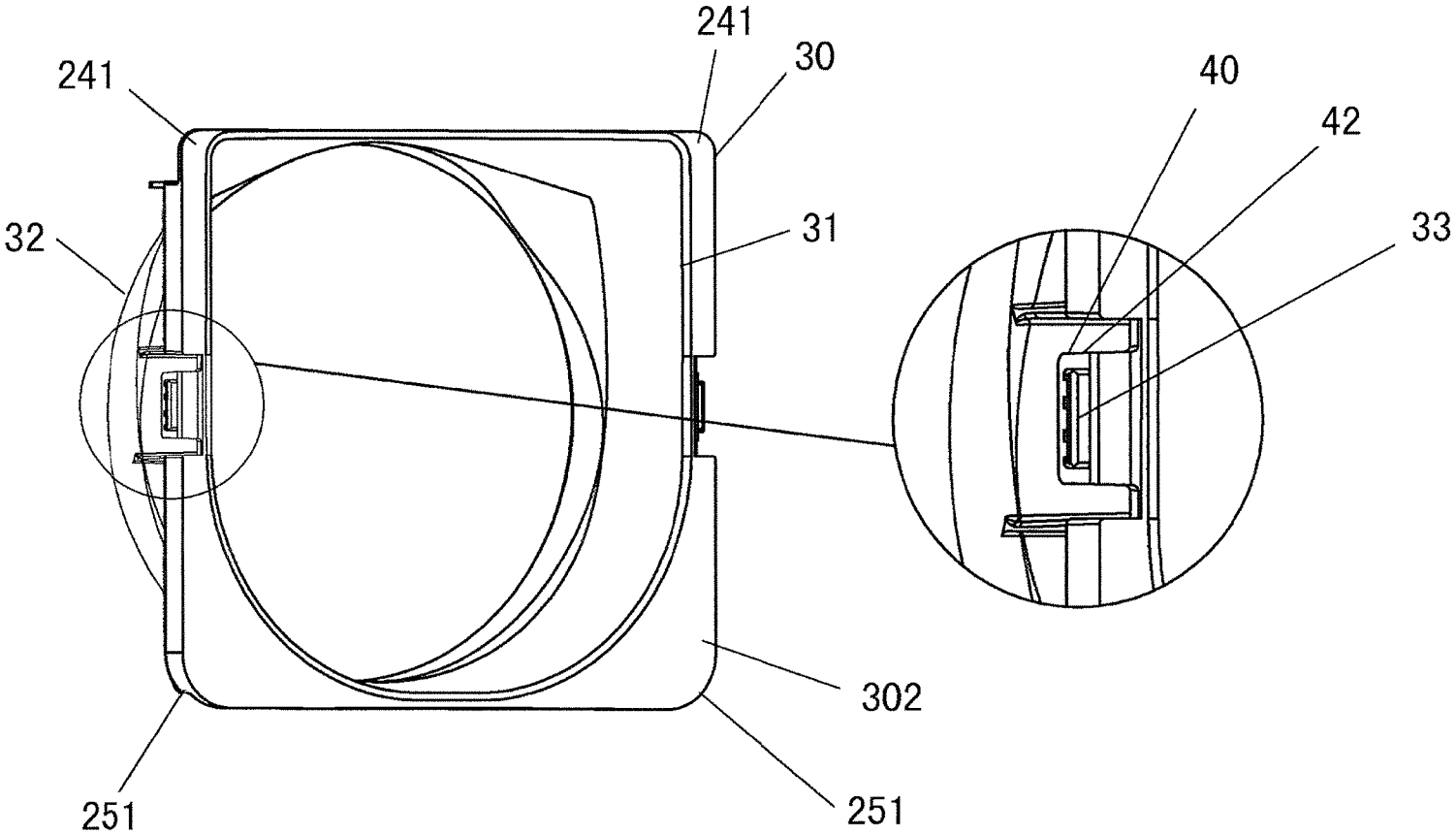
FIG. 4A is a schematic diagram of a first example of an air guide structure according to the first embodiment of the present disclosure.
Figure 4B:
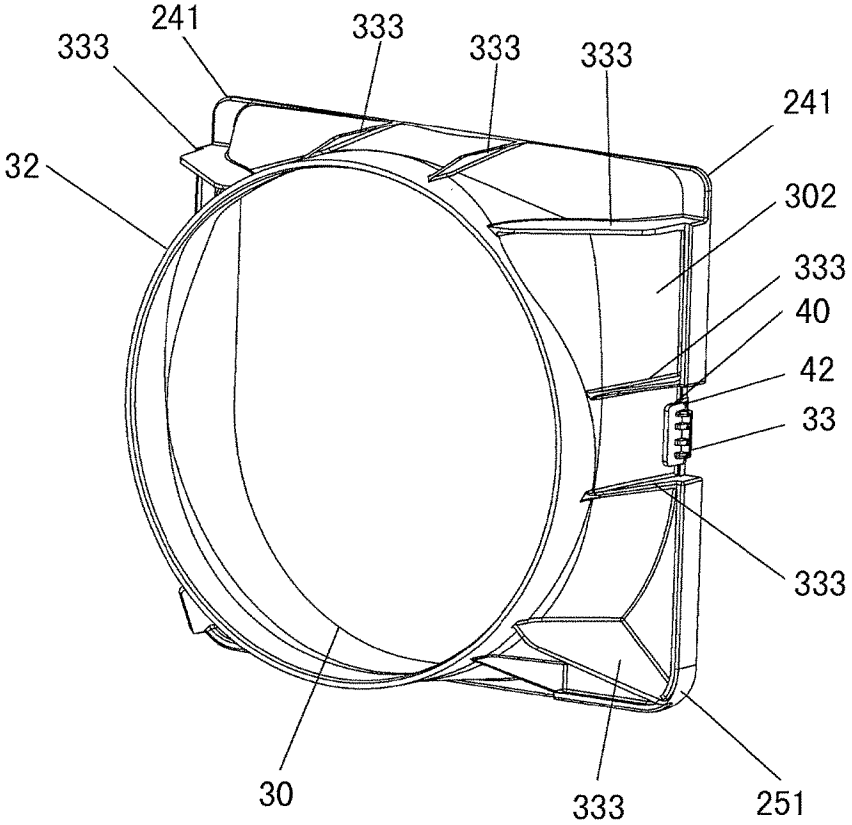
FIG. 4B is a schematic diagram of a second example of the air guide structure according to the first embodiment of the present disclosure.
Figure 5:
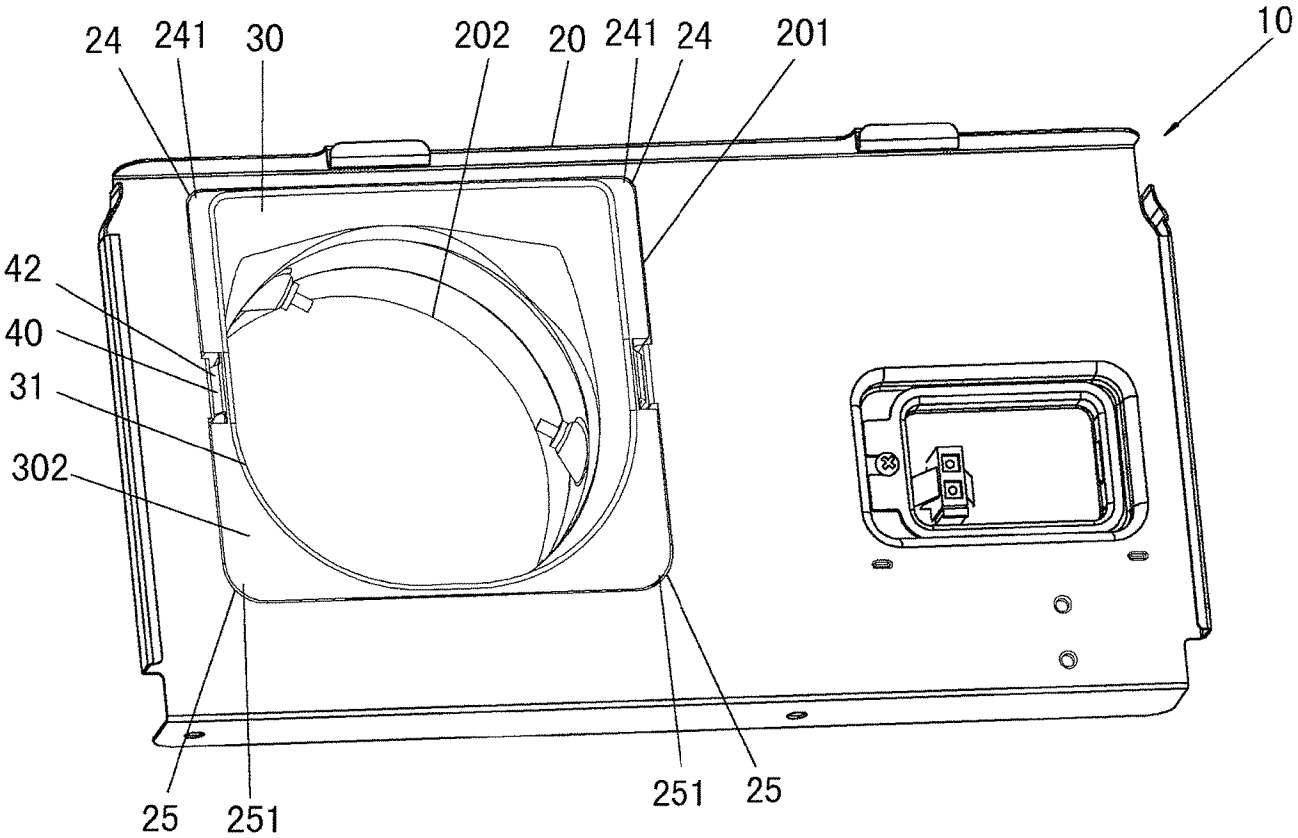
FIG. 5 is a schematic diagram showing an assembly of the adapter and the air guide structure according to the first embodiment of the present disclosure.
Figure 6:
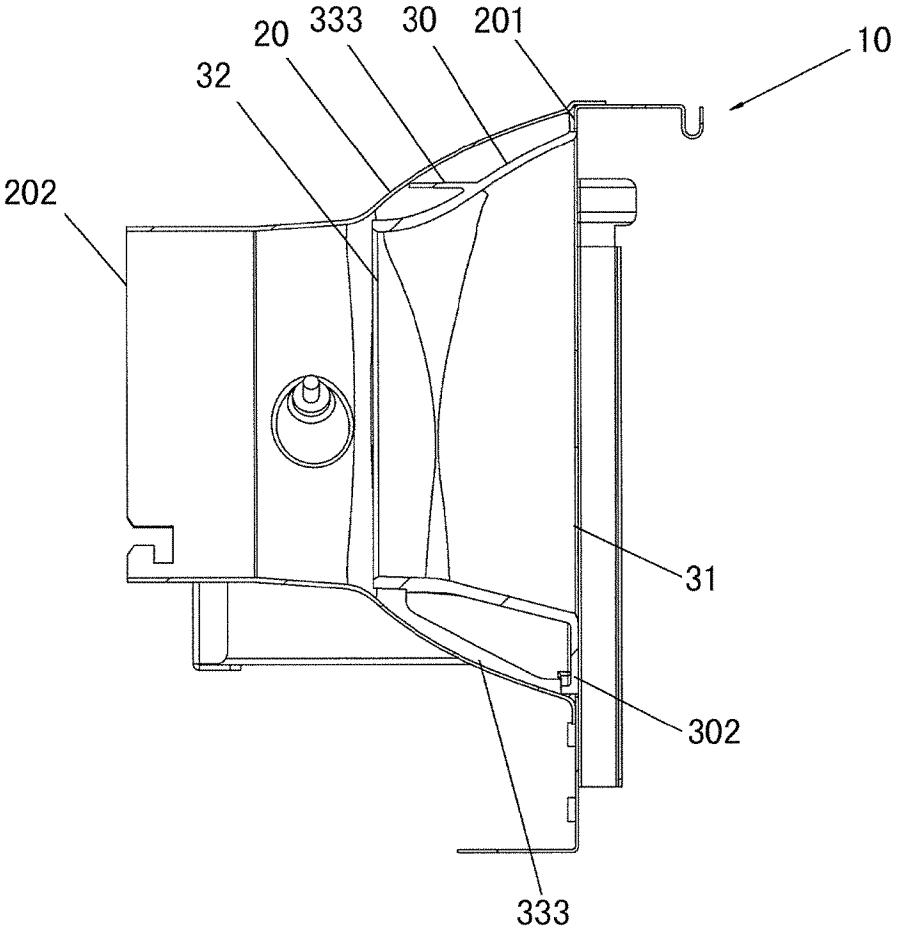
FIG. 6 is a longitudinal sectional view showing the assembly of the adapter and the air guide structure according to the first embodiment of the present disclosure.

FIG. 2 is an exploded view of a ventilating fan according to a first embodiment of the present disclosure; FIG. 3 is a schematic diagram of an adapter according to the first embodiment of the present disclosure; FIG. 4A is a schematic diagram of a first example of an air guide structure according to the first embodiment of the present disclosure; FIG. 4B is a schematic diagram of a second example of the air guide structure according to the first embodiment of the present disclosure; FIG. 5 is a schematic diagram showing an assembly of the adapter and the air guide structure according to the first embodiment of the present disclosure; and FIG. 6 is a longitudinal sectional view showing the assembly of the adapter and the air guide structure according to the first embodiment of the present disclosure.

As shown in FIG. 2 to FIG. 6, an adapter structure 10 for a ventilating fan according to the first embodiment of the present disclosure comprises an adapter 20 and an air guide structure 30 mounted within the adapter 20. The air guide structure 30 is mounted within the adapter 20 through a mounting structure 40. The mounting structure 40 comprises a first portion provided at an outer side of a flange 302 around an air inlet 31 of the air guide structure 30 and a second portion provided at an inner side of the adapter 20, and thus the mounting structure 40 is located between an inner side of an air inlet 201 of the adapter 20 and an outer side of the air inlet 31 of the air guide structure 30.

Further, although the mounting structures 40 are provided at left and right positions in the first embodiment and in subsequently described second and third embodiments, the number and the positions of the mounting structures 40 are not limited.

Figure 1:
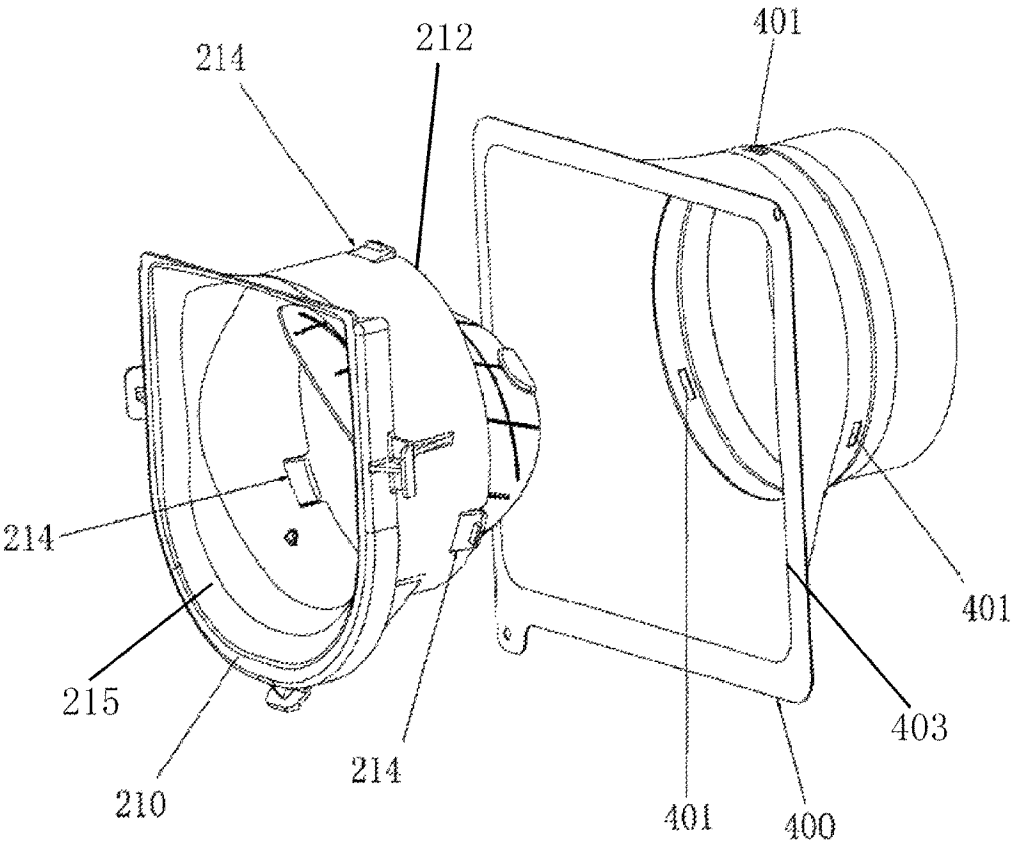
Fig. 1 Prior Art
FIG. 1 is a schematic diagram showing an adapter structure of a ventilating fan in the prior art.

As an air guide structure 210 (with reference to FIG. 1) in the related art ZL201010130174.1, the air guide structure 30 of this embodiment is provided with two parts: the air inlet 31 having the same shape as an air outlet 51 of a casing 50 covering a fan 52 and a cylindrical air outlet 32. In this embodiment, the air inlet 31 of the air guide structure 30 is formed in a shape consisting of an arcuate lower portion and a square upper portion, as is the air outlet 51 of the casing 50, and the air inlet 31 of the air guide structure 30 is transmitted to the air outlet 32 opposite to the air inlet 31 smoothly from the fan 52. Thus, an airflow generated by the fan 52 is blown from the air outlet 51 to the air inlet 31 of air guide structure 30 smoothly without colliding with an inner wall of the air inlet 31 of the air guide structure 30 and thus no turbulent flow will be generated. That is, resistance due to the difference in shape between the air outlet 51 and the air inlet 31 is removed, and the air can be blown from the air outlet 51 to the air inlet 31 smoothly.

Further, the mounting structure 40 is located between the inner side of an air inlet 201 of the adapter 20 and the outer side of the air inlet 31 of the air guide structure 30, that is, the mounting structure 40 is located on an outer side of an airflow path from the air outlet 51 of the casing 50 through the air guide structure 30 to the air outlet 202 of the adapter 20. Therefore, the mounting structure 40 will not block the airflow on an inner side thereof, thereby will not reducing the sectional area of the airflow; further, since the airflow will not collide against the mounting structure 40, no airflow will leak out from an opening 23 in the mounting structure 40.

Specifically, the above described first portion of the mounting structure 40 is an elastic clamping jaw 42 provided at an outer side of the flange 302 of the air inlet 31 of the air guide structure 30, the above described second portion of the mounting structure 40 is a hook portion 22 with the opening 23 provided on the inner wall of the adapter 20, and the clamping jaw 42 is provided with protrusions 33 on a side thereof near to the inner wall of the adapter 20 to snap into the opening 23.

When the air guide structure 30 is inserted into the adapter 20, the air outlet 32 of the air guide structure 30 enters the adapter 20, the protrusions 33 on the elastic clamping jaw 42 at an outer side of the flange 302 of the air inlet 31 of the air guide structure 30 contact the hook portion 22 on the inner wall of the adapter 20, so that the clamping jaw 42 is elastically deformed towards inside of the air guide structure 30 by a pressing force from the hook portion 22; when the air guide structure 30 is further inserted into the adapter 20, the protrusions 33 on the clamping jaw 42 enter the opening 23 of the hook portion 22; under the elasticity of the clamping jaw 42, the protrusions 33 on the clamping jaw 42 move outwardly of the air guide structure 30 so as to be snapped at the opening 23 of the hook portion 22. As such, the air guide structure 30 is firmly fixed into the adapter 20.

Of course, the mounting structure 40 is not limited to the above structure; the mounting structure 40 may have other structures, as long as the mounting structure 40 is provided on a outer side of the airflow path from the air outlet 51 of the casing 50, through the air guide structure 30, to the air outlet 202 of the adapter 20, thereby avoiding leakage of the air. The first portion and the second portion of the mounting structure 40 may be connected in a snapping way, or in other ways such as riveting connection, screwing connection.

Further, as shown in FIG. 5, the air inlet 201 of the adapter 20 has a square shape with rounded corners, and two upper rounded angles 24 of the rounded square have a curvature different from that of two lower rounded angles 25 of the rounded square, and the flange 302 of the air inlet 31 of the air guide structure 30 has a shape corresponding to the shape of the air inlet 201 of the adapter 20.

In order to reduce a height difference between the air outlet 51 of the casing 50 and the air inlet 201 of the adapter 20, the air inlet 31 of the air guide structure 30 is formed to have the same shape as the air outlet 51 of the casing 50, for example, as described above, being a square shape with an arcuate lower portion). If the air guide structure 30 is mounted upside down, the shape of the air inlet 31 of the air guide structure 30 will not be the same as that of the air outlet 51 of the casing 50, which cannot obtain the effect of smoothing the air flow. The two upper rounded angles 24 of the air inlet 201 of the adapter 20 are formed to have a curvature different from that of the two lower rounded angles 25 of the air inlet 201 of the adapter 20, and the shape of the flange 302 of the air inlet 31 of the air guide structure 30 is provided to mate with the shape of the air inlet 201 of the adapter 20. Specifically, two upper rounded angles 241 of the flange 302 of the air inlet 31 of the air guide structure 30 also have a curvature different from that of two lower rounded angles 251 of the flange 302 of the air inlet 31 of the air guide structure 30. For example, the curvature of the two upper rounded angles 24 or 241 of the air inlet 201 of the adapter 20 and the flange 302 of the air inlet 31 of the air guide structure 30 are smaller than that of the two lower rounded angles 25, 251 thereof respectively. As such, if the air guide structure 30 is mounted upside down into the adapter 20, since the rounded angles 241, 251 of the flange 302 of the air inlet 31 of the air guide structure 30 and the rounded angles 25, 24 of the air inlet 201 of the adapter 20 have different curvatures and will interfere with each other, the air guide structure 30 cannot be fitted into the adapter 20. As such, if the air guide structure 30 is to be mounted within the adapter 20 by a user in an incorrect orientation, the air guide structure 30 cannot be mounted. Thus, the air guide structure 30 is prevented from being mounted upside down within the adapter 20, thereby ensuring an unobstructed airflow. Taking the adapter 20 and the air guide structure 30 as an example, the curvature of the two upper rounded angles 241 is smaller than that of the two lower rounded angles 251. When the air guide structure 30 is mounted, the two upper rounded angles 241 of the air guide structure 30 having smaller curvature are firstly mounted within the air inlet 201 of the adapter 20 forcibly. Then, the two lower rounded angles 251 on the other side can be mounted easily and freely, thereby improving mounting operability.

Further, as shown in FIGS. 4B and 6, ribs 333 are integrally provided on an outer wall of the air guide structure 30 and extended to contact the inner wall of the adapter 20. The ribs 333 integrally provided on the outer wall of the air guide structure 30 provide a strengthening effect for preventing the air guide structure 30 from being deformed due to an external force applied on a certain part of the air guide structure 30. In addition, since the ribs 333 extend to contact the adapter 20, not only the air guide structure 30 can be correctly mounted within the adapter 20 through the mounting structure 40, but also the air guide structure 30 can tightly contact the inner wall of the adapter 20 through the ribs 333 on the outer wall thereof, thereby the air guide structure 30 is more stably fixed within the adapter 20, so that the air guide structure 30 is prevented from being blown by the airflow to misfit in the air outlet 51 of the casing 50 and thus a gap will occur between the air inlet 31 of the air guide structure 30 and the air outlet 51 of the casing 50, resulting in the airflow leaking out from the gap and sharply diffusing to generate abnormal noise.

The ribs 333 may be in the form of a sheet. Compared to the solution in which the outer wall of the air guide structure 30 is thickened so that it extends to the inner wall of the adapter 20, the sheet ribs 333 can be provided to be thinner, thereby saving materials for the ribs.

The sheet ribs 333 can be provided in a shape of irregular quadrangle, pentagon, hexagon or the like, as long as the shapes of the ribs 333 are designed to suit the shape of the inner wall of the adapter 20. Further, the number of the ribs 333 is not limited, as long as the air guide structure 30 can be stably fixed within the adapter 20. For example, 12 ribs 333 are provided in this embodiment.

Figure 7:
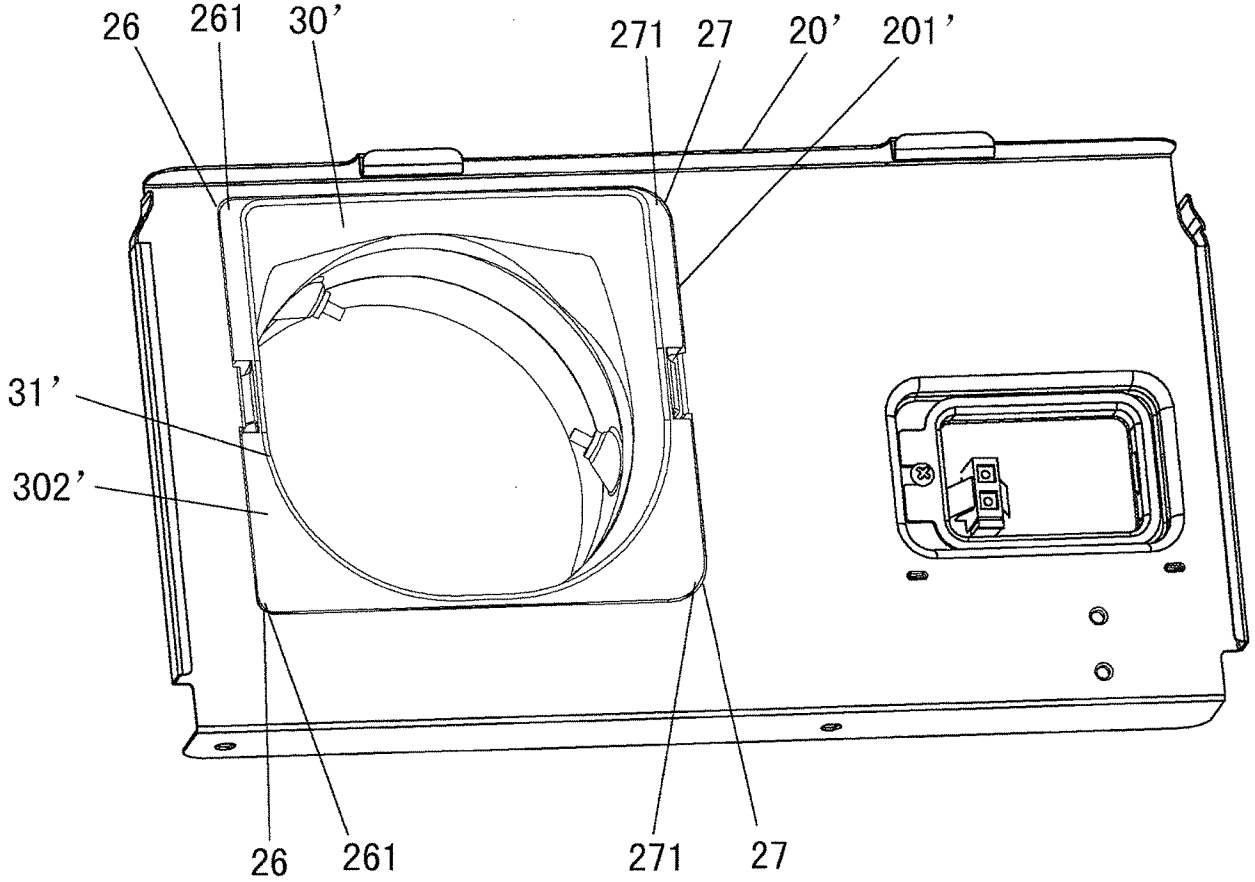
FIG. 7 is a schematic diagram showing an assembly of the adapter and the air guide structure according to a second embodiment of the present disclosure.

FIG. 7 is a schematic diagram showing an assembly of the adapter and the air guide structure according to a second embodiment of the present disclosure. The second embodiment is different from the first embodiment only in the different curvatures of the angles of the air inlet of the adapter. In the second embodiment, the air inlet 201' of the adapter 20' has a square shape with rounded angles, and the curvature of two left rounded angles 26 is different from that of two right rounded angles 27, and a flange 302' of the air inlet 31' of the air guide structure 30' has a shape corresponding to that of the air inlet 201' of the adapter 20'.

In this embodiment, the two left rounded angles 26 of the air inlet 201' of the adapter 20' are formed to have a curvature different from that of the two right rounded angles 27 of the air inlet 201' of the adapter 20', and the shape of the flange 302' of the air inlet 31' of the air guide structure 30' is provided to mate with the shape of the air inlet 201' of the adapter 20', that is, two left rounded angles 261 of the flange 302' of the air inlet 31' of the air guide structure 30' also have a curvature different from that of two right rounded angles 271 of the flange 302' of the air inlet 31' of the air guide structure 30'. For example, the curvature of the two left rounded angles 26, 261 of the air inlet 201' of the adapter 20' and the flange 302' of the air inlet 31' of the air guide structure 30' is smaller than that of the two right rounded angles 27, 271 thereof respectively. therefore, when the air guide structure 30' is to be mounted upside down within the adapter 20', since the rounded angles 261, 271 of the flange 302' of the air inlet 31' of the air guide structure 30' and the rounded angles 27, 26 of the air inlet 201' of the adapter 20' have different curvatures and will interfere with each other, the air guide structure 30' cannot be mounted within the adapter 20'. As such, if the air guide structure 30' is to be mounted within the adapter 20' by a user in an incorrect orientation, the air guide structure 30' cannot be mounted. Thus, the air guide structure 30' is prevented from being mounted upside down within the adapter 20', thereby ensuring an unobstructed airflow path. Taking the adapter 20' and the air guide structure 30' as an example, when the air guide structure 30' is mounted by a right hand of the populous right handed people, the two left rounded angles 261 of the air guide structure 30' having small curvature are firstly mounted within the air inlet 201' of the adapter 20' forcedly. Then, the two right rounded angles 271 on the other side can be mounted easily and freely, thereby improving mounting operability.

Figure 8:
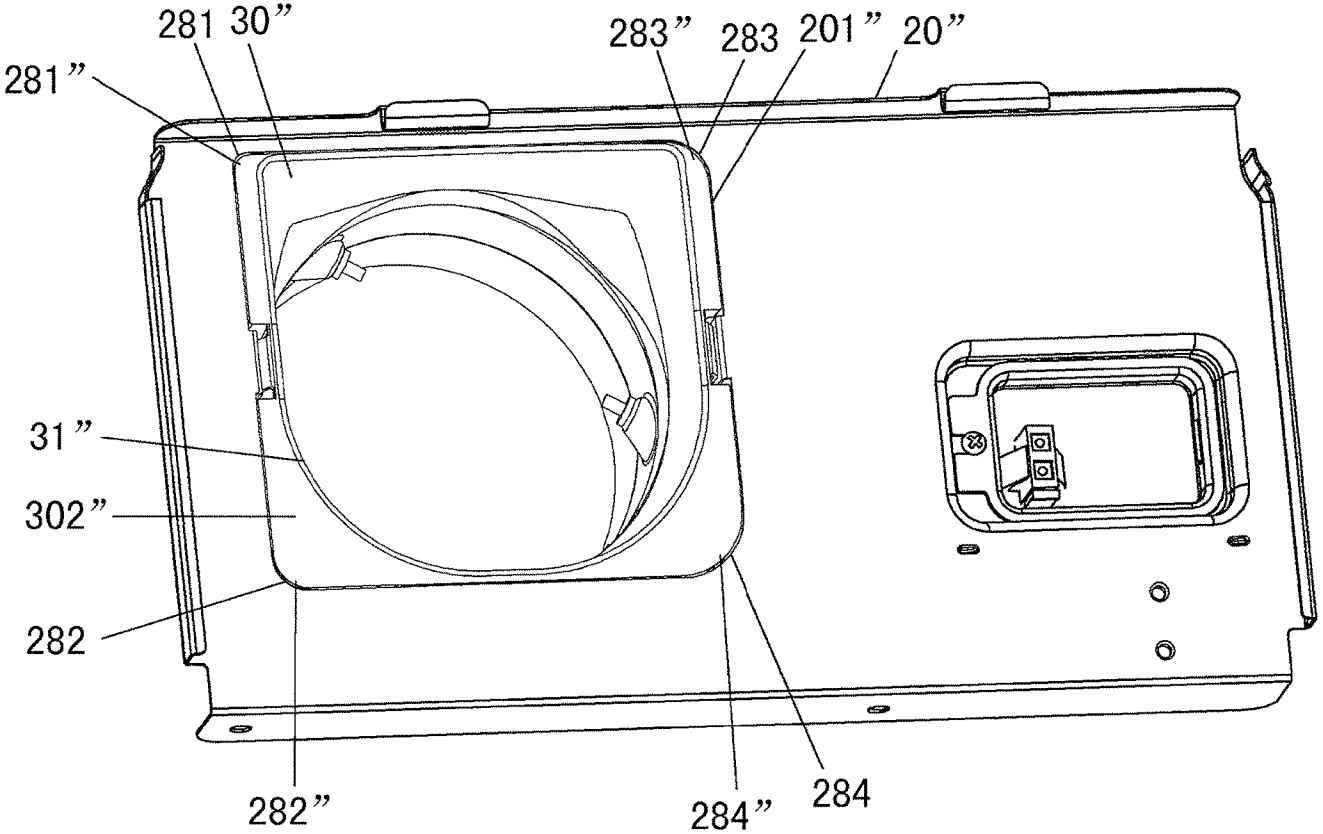
FIG. 8 is a schematic diagram showing an assembly of the adapter and the air guide structure according to a third embodiment of the present disclosure.

FIG. 8 is a schematic diagram showing an assembly of the adapter and the air guide structure according to a third embodiment of the present disclosure. The third embodiment is different from the first and the second embodiment only in the different curvatures of the angles of the air inlet of the adapter. In the third embodiment, the air inlet 201" of the adapter 20" has a square shape with rounded angles, and the curvatures of four rounded angles 281, 282, 283, 284 are different from one another, and a flange 302" of the air inlet 31" of the air guide structure 30" has a shape corresponding to that of the air inlet 201" of the adapter 20".

In this embodiment, the four rounded angles 281, 282, 283, 284 of the air inlet 201" of the adapter 20" are formed to have curvatures different one another, and the shape of the flange 302" of the air inlet 31" of the air guide structure 30" is provided to mate with the shape of the air inlet 201" of the adapter 20", that is, four rounded angles 281", 282", 283", 284" of the flange 302" of the air inlet 31" of the air guide structure 30" also have curvatures different from one another. As such, when the air guide structure 30" is to be mounted upside down within the adapter 20", since the rounded angles 281", 282", 283", 284" of the flange 302" of the air inlet 31" of the air guide structure 30" and the rounded angles 281, 282, 283, 284 of the air inlet 201" of the adapter 20" have different curvatures and will interfere with each other, the air guide structure 30" cannot be fitted within the adapter 20". As such, if the air guide structure 30" is to be mounted within the adapter 20" by a user in an incorrect orientation, the air guide structure 30" cannot be mounted. Thus, the air guide structure 30" is prevented from being mounted incorrectly within the adapter 20", thereby ensuring an unobstructed airflow path.

Of course, the structure for preventing the air guide structure from being mounted upside down within the adapter is not limited to those described in the above first, second or third embodiment; for example, protrusions may be provided on a side of the air guide structure, and notches are provided on corresponding sides of the adapter to receive the respective protrusions therein.

What is claimed is:

1. A ventilating fan, comprising:

a casing having an air outlet; and an adapter structure adapted to be mounted to the air outlet of the casing of the ventilating fan, the adapter structure comprising:

an adapter having an air inlet and an air outlet;

an air guide structure having an air inlet and an air outlet, a circumferential wall of the air guide structure being configured to fluidly isolate an airflow path between the air inlet and the air outlet of the air guide structure from a space around and outside of the circumferential wall such that the air introduced from the air inlet of the air guide structure can only flow out from the air outlet of the air guide structure, and, the air inlet of the air guide structure having a same shape as that of the air outlet of the casing, and a mounting structure for mounting the air guide structure within the adapter, wherein the mounting structure comprises a first portion provided at an outer side of a flange of the air inlet of the air guide structure and a second portion provided on an inner wall of the adapter, wherein the first portion of the mounting structure and the second portion of the mounting structure are fixedly connected with each other such that the air guide structure is mounted and fixed to the adapter and the mounting structure is positioned between the air inlet of the air guide structure and the air inlet of the adapter so that no airflow will leak out from the mounting structure, and the mounting structure is located on an outer side of an airflow path from the air outlet of the casing through the air guide structure to the air outlet of the adapter such that the airflow will not collide against the mounting structure.

2. The ventilating fan according to claim 1, wherein the first portion of the mounting structure is an elastic clamping jaw provided at an outer side of the flange of the air inlet of the air guide structure, the second portion of the mounting structure is a hook portion provided on the inner wall of the adapter and having an opening, and the clamping jaw is provided with protrusions on a side thereof adjacent to the inner wall of the adapter to be snapped into the opening.

3. The ventilating fan according to claim 1, wherein the air inlet of the adapter has a shape in the form of a rounded square, two rounded angles at one side of four sides of the rounded square have a curvature different from that of two rounded angles at another side of the four sides of the rounded square opposite to and parallel to the one side, and the flange of the air inlet of the air guide structure has a shape corresponding to the shape of the air inlet of the adapter.

4. The ventilating fan according to claim 3, wherein the curvature of the two rounded angles at the one side of the four sides of the rounded square is smaller than that of the two rounded angles at the another side of the four sides of the rounded square opposite to and parallel to the one side.

5. The ventilating fan according to claim 1, wherein the air inlet of the adapter has a shape in the form of a rounded square, of which four rounded angles have curvatures different from one another, and the flange of the air inlet of the air guide structure has a shape corresponding to the shape of the air inlet of the adapter.

6. The ventilating fan according to claim 1, wherein ribs are integrally provided on an outer wall of the air guide structure and extended to contact the inner wall of the adapter.

7. The ventilating fan according to claim 1, wherein the first portion of the mounting structure and the second portion of the mounting structure are fixedly connected with each other by way of snapping engagement.

* * * * *